US006341875B1

(12) United States Patent
Chu

(10) Patent No.: US 6,341,875 B1
(45) Date of Patent: Jan. 29, 2002

(54) DECORATIVE LIGHTING ASSEMBLY

(75) Inventor: Jack Shao-Chun Chu, Alhambra, CA (US)

(73) Assignee: Yun Shao Mei, Taipei (TW)

( * ) Notice: Subject to any disclaimer, the term of this patent is extended or adjusted under 35 U.S.C. 154(b) by 0 days.

(21) Appl. No.: 09/606,440

(22) Filed: Jun. 30, 2000

(51) Int. Cl.[7] ..... F21V 19/00; H01R 4/60; H01R 31/08

(52) U.S. Cl. ..... 362/252; 362/226; 362/806; 439/210; 439/509

(58) Field of Search ..... 362/219, 226, 362/227, 249, 252, 806–808, 800; 439/209, 210, 213, 214, 216, 507, 509

(56) References Cited

U.S. PATENT DOCUMENTS 851,024 A * 4/1907 McGinley ..... 439/210
4,812,956 A * 3/1989 Chen ..... 362/249
4,875,871 A * 10/1989 Booty, Sr. et al. ..... 439/209
5,018,055 A * 5/1991 Wu ..... 362/249
5,337,225 A * 8/1994 Brookman ..... 362/226
5,494,460 A * 2/1996 Kaiser ..... 439/509
5,683,172 A * 11/1997 Huag ..... 362/252
6,074,073 A * 6/2000 Huang ..... 362/226

* cited by examiner

*Primary Examiner*—Alan Cariaso
(74) *Attorney, Agent, or Firm*—David and Raymond Patent Group; Raymond Y. Chan

(57) ABSTRACT

A decorative lighting assembly includes a plurality of illuminating units each having an illuminator detachably mounted thereon, a plurality of connecting frame each having at least two connectors for selectively and electrically connecting the illuminating units together to form a specify shape. Accordingly, the decorative lighting assembly enables the user to customize the arrangement of the illuminating units to form a 2D, 3D, and other specify decorative figures.

20 Claims, 16 Drawing Sheets

DECORATIVE LIGHTING ASSEMBLY

BACKGROUND OF THE PRESENT INVENTION

1. Field of Invention

The present invention relates to lights, and more particularly to a decorative lighting assembly comprises a plurality of illuminating units selectively arrayed in different arrangement for providing a three-dimensional light decoration.

2. Description of Related Arts

Conventional decorative lighting assembly, especially for Christmas tree, comprises a plurality of light units having different colored light bulbs mounted thereon integrally connected with a wire such that the conventional decorative lighting assembly can be hung over a ceiling of the house or twisted on the Christmas tree.

Since the wire is flexible, when a user wants to arrange the conventional lighting assembly in order to form a desired shape or a three-dimensional figure, the user must need a base supporter for hanging the lighting assembly thereon. Furthermore, the conventional lighting assembly is hard to form an arc shape or a curve shape such that the user may unsatisfy the result of decoration with the conventional light assembly.

Moreover, the wire usually has a predetermined length such as 25 feet long. The user always has difficulty to use since the wire is easy to intertwine together while dispensing the wire. Thus, the user cannot preset the optimum length of the conventional lighting assembly such that the exact length of the wire may be a waste of resource.

SUMMARY OF THE PRESENT INVENTION

A main object of the present invention is to provide a decorative lighting assembly that capable of selectively arranging to form any structure, especially a three-dimensional figure.

Another object of the present invention is to provide a decorative lighting assembly which is easy to assemble for use and disassemble into pieces for storage and carriage.

Another object of the present invention is to provide a decorative lighting assembly that adapted for using both AC and DC current such that the decorative lighting assembly can be set up outdoors and indoors for convenience.

Accordingly, in order to accomplish the above objects, the present invention provides a decorative lighting assembly, comprising:

- a plurality of illuminating units each comprising a base having at least two end terminals provided on the base, a pair of conductive arms upwardly extended from the base wherein the end terminals are selectively and electrically connected to the conductive arms respectively, a casing sealedly mounted on the base, and an illuminator detachably mounted on the casing,
- a plurality of connecting frames each comprising at least two connectors at two ends thereof respectively for electrically connecting with the end terminal of the illuminating unit, so as to electrically connect the illuminating units together in such a manner that the illuminating units are selectively aligned to form a dimensional arrangement, and
- a power output device electrically connected the illuminating units with a power source.

DETAILED DESCRIPTION OF THE PREFERRED EMBODIMENT

Figure 1:
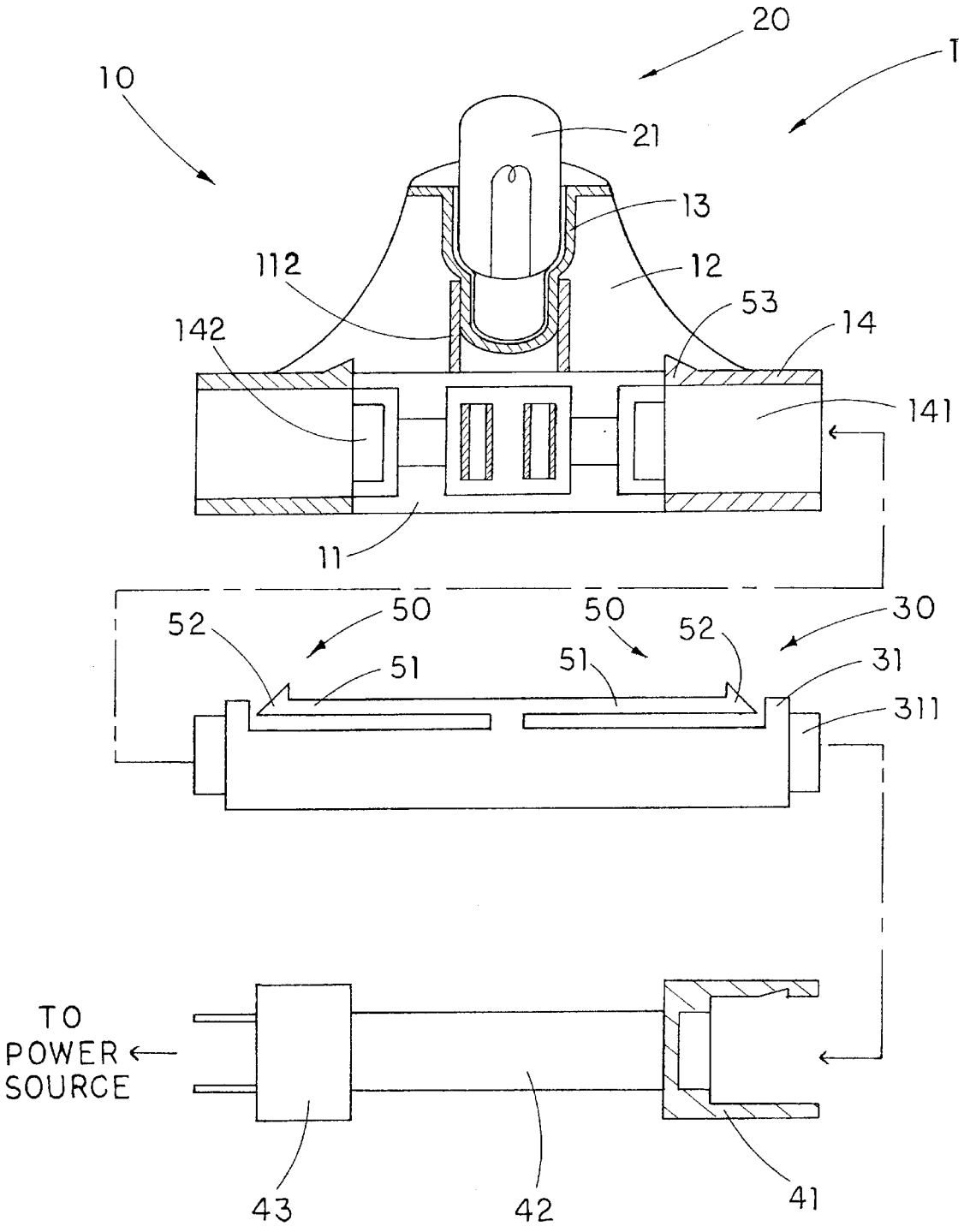
FIG. 1 is a sectional side view of a decorative lighting assembly according to a preferred embodiment of the present invention.

Referring to FIG. 1 of the drawing, a decorative lighting assembly 1 according to a preferred embodiment of the present invention is illustrated, which comprises a plurality of illuminating units 10 each having a detachably illuminator 20 mounted thereon, a plurality of connecting frame 30 for electrically connecting the illuminating units 10 together, and a power output device 40 for electrically connecting the decorative lighting assembly 1 with a power source.

Figure 2:
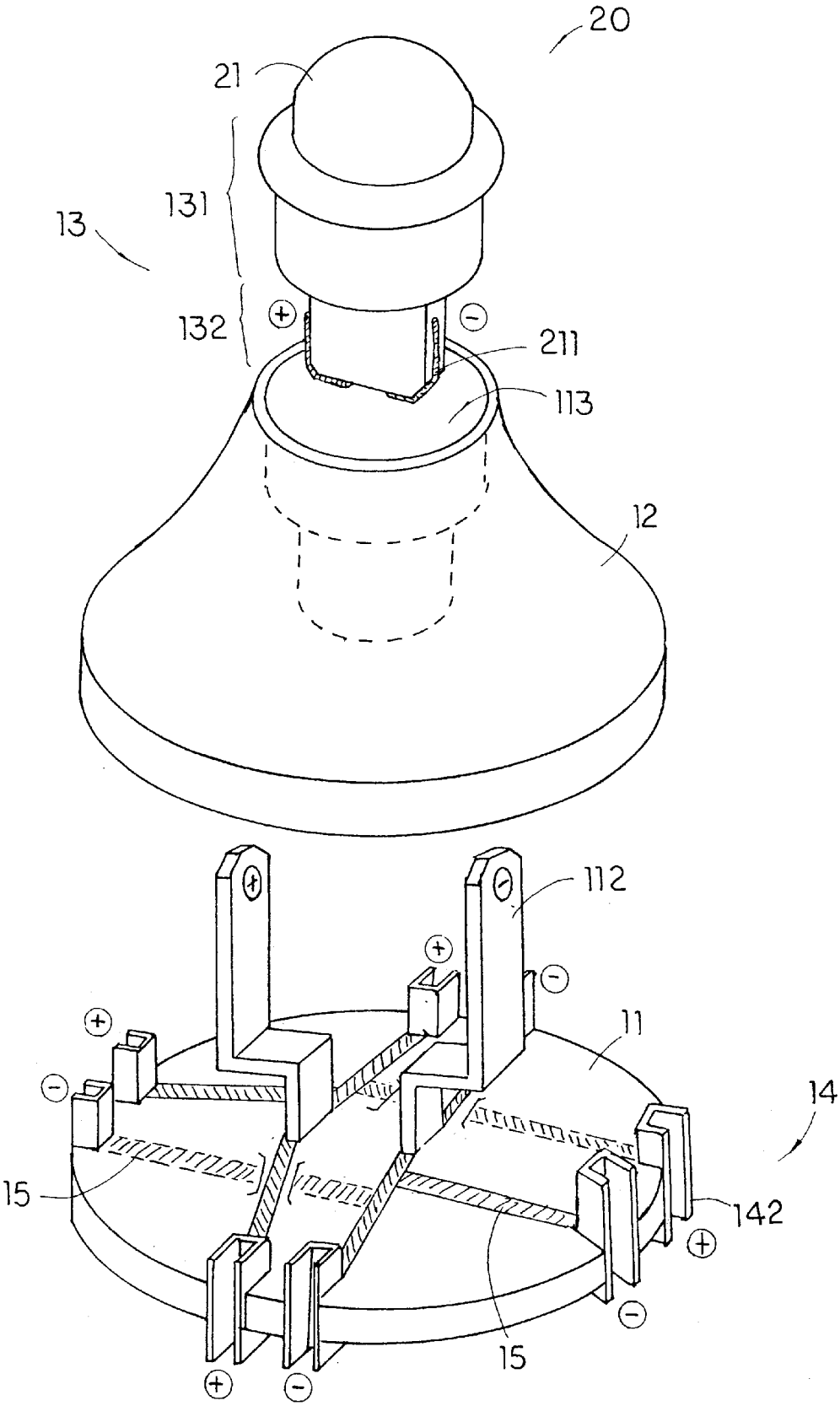
FIG. 2 is an exploded perspective view of the illuminating unit of the decorative lighting assembly according to the above preferred embodiment of the present invention.

As shown in FIG. 2, each illuminating unit 10 comprises a circular base 11 comprising a plurality of end terminals 14 evenly provided on a circumference of the base 11 and a pair of conductive arms 112 having a positive and negative sign respectively upwardly extended from the base 11, and a casing 12 sealedly mounted on the base 11 wherein a hollow holder chamber 113 is coaxially defined in the casing 12 such that the illuminating element 20 is securely disposed in the holder chamber 113 in position.

In order to protect the base 11, the casing 12 is sealedly mounted on the base 11 in such a water tight manner so as to prevent rain, dust and moisture from entering into the illuminating unit 10. Preferably, the casing 12 is made of durable, electric-resistance material such as plastic for preventing the water from entering into the base 11 which may damage the illuminating unit 10.

Accordingly, the illuminator 20 is preferably a LED 21 adapted for selectively providing different colors to the illuminating units 10 wherein the LED 21 is relatively inexpensive, so as to decrease the cost of the present invention. Thus, the illuminator 20 can also be a regular light bulb as an alternative element of the LED 21 for easy installation.

Each LED 21 of the illuminator 20 has a pair of charging legs 211 having a positive and negative sign respectively downwardly extended from the LED 21. In order to hold the illuminator 20 in position, the LED 21 of the illuminator 20 is securely held in a holder 13 wherein the holder 13 is adapted to fittingly insert into the holder chamber 113 in such an air tight manner. The holder 13 has a circular top portion 131 and a rectangular bottom portion 132 wherein the LED 21 is fittingly disposed in the holder 13. Thus, the positive and negative sign charging legs 211 of the LED 21 are penetrated through the bottom portion 132 of the holder 13 and are bently encircling at two opposing sides of the bottom portion 132 of the holder 13, as shown in FIG. 2. In such arrangement, when the holder 13 is inserted into the holder chamber 113, the charging legs 211 of the LED 21 are electrically connected to the conductive arms 112 of the base 11 respectively with respect to the corresponding sign thereof, so as to electrically connecting between the base 11 and the illuminator 20.

The plurality of end terminals 14 are evenly provided on the circumference of the base 11 wherein each end terminal 14 comprises a guiding slot 141 provided therein such that an end portion of the connecting frame 30 is adapted for fitly inserting into the guiding slot 141. Furthermore, as shown in FIG. 2, each guiding slot 141 of the end terminals 14 at its inner end has a pair of charging slits 142 having a positive and negative signs parallelly mounted thereon.

Figure 3C:
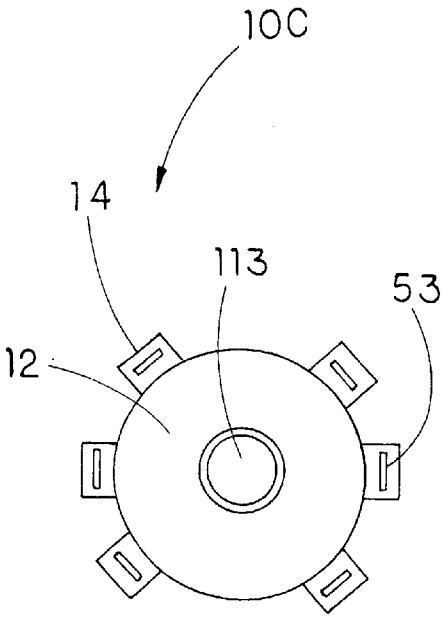
FIGS. 3A to 3D illustrate the end terminal and its alternative modes of the decorative lighting assembly according to the above preferred embodiment of the present invention.
Figure 3B:
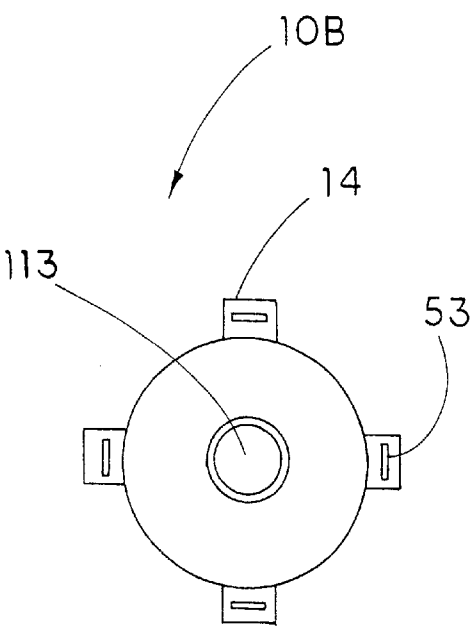
Figure 3A:
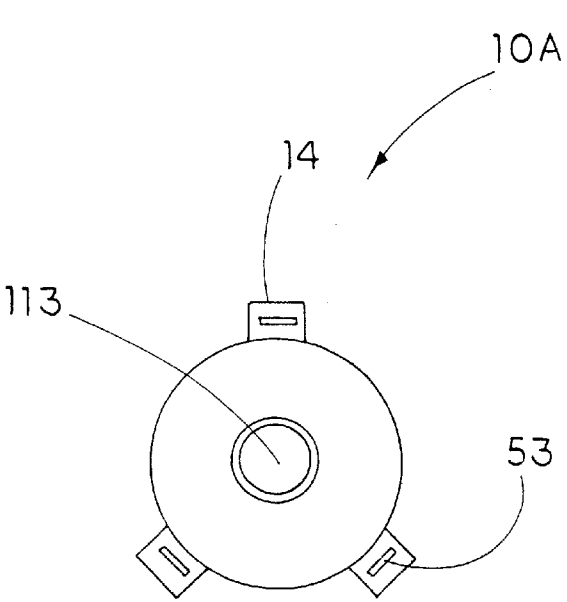
Figure 3D:
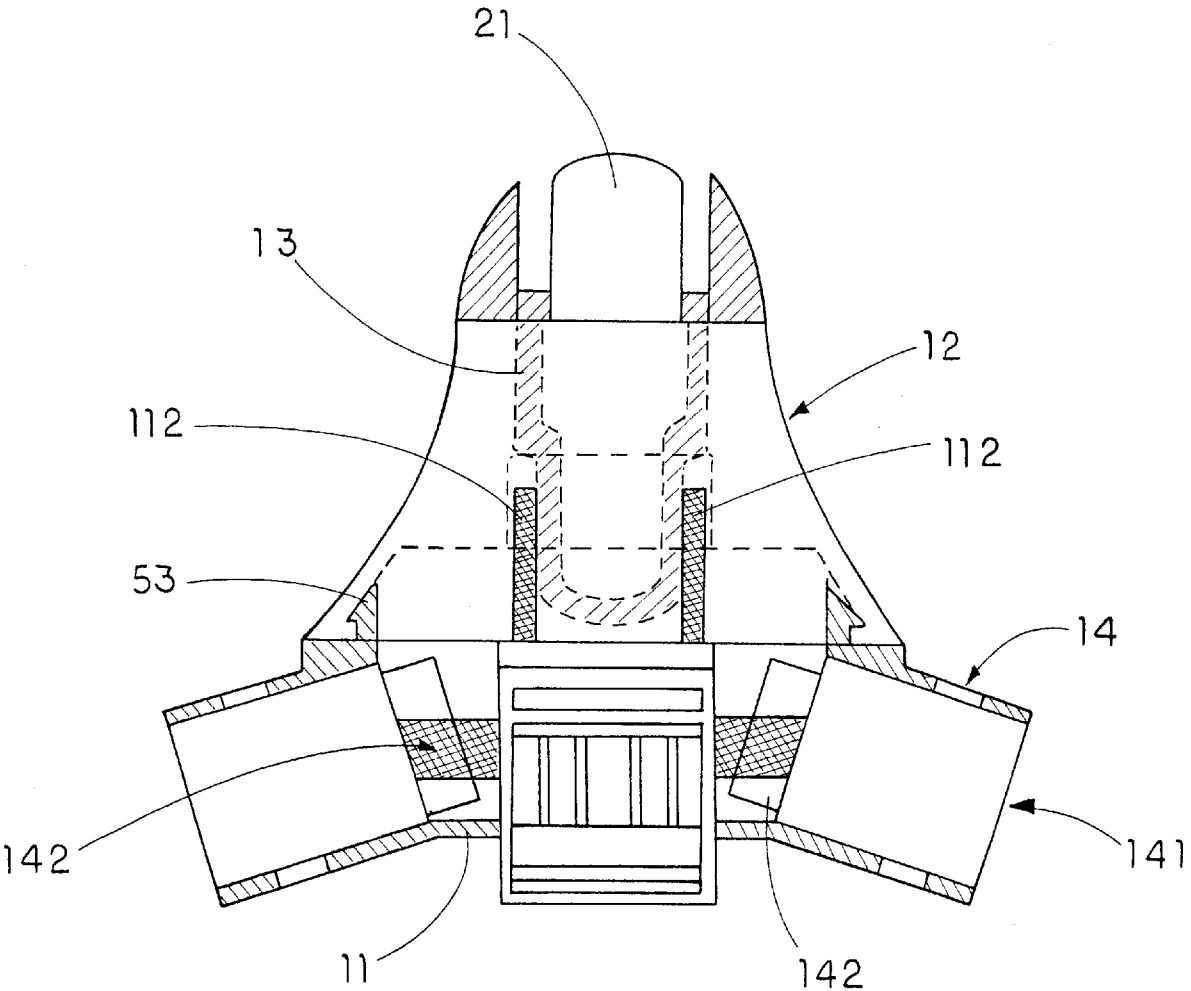

As shown in FIGS. 3A to 3C, each illuminating unit 10 comprises a predetermined number of end terminals 14 such as three, four, and six end terminals 14 wherein different arrangement of the illuminating units 10 can be formed such as cubic shape according to the number of the end terminals 14. In other words, the illuminating units 10 are selectively arranged to form different shape by using respective number of end terminals 14. Alternatively, the end terminal 14 can be formed inclindedly with respect to the base 11, as shown in FIG. 3D, so as to assemble the illuminating units 11 to form a spherical shape.

Each connecting frame 30 having a rectangular cross section comprises at least two connectors 31 each mounted at an end thereof for engaging with the end terminal 14 of the illuminating unit 10 through the guiding slot 141, so as to electrically connect the illuminating units 10 together. Each connector 31 comprises a pair of corresponding charging head 311 for electrically connecting with the charging slits 142 of the end terminal 111 respectively.

Figure 4A:
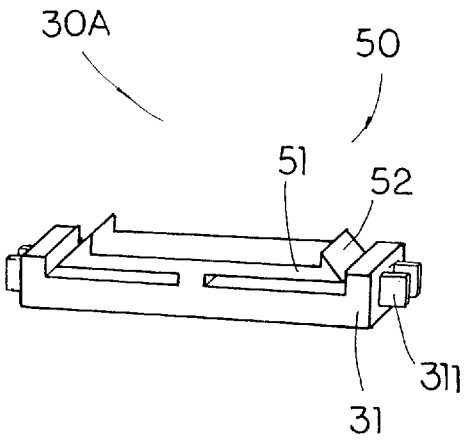
FIGS. 4A to 4G illustrate the connecting frame and its alternative modes of the decorative lighting assembly according to the above preferred embodiment of the present invention.
Figure 4B:
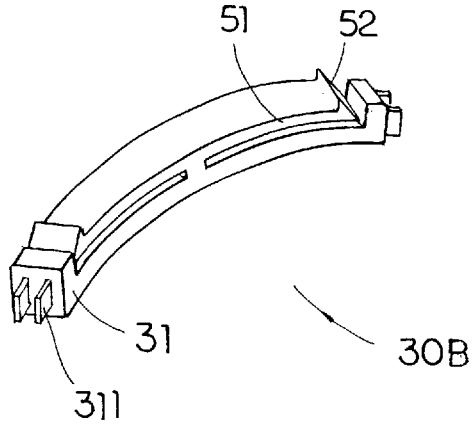
Figure 4C:
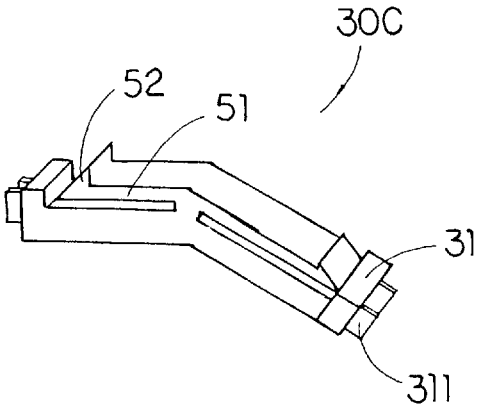
Figure 4D:
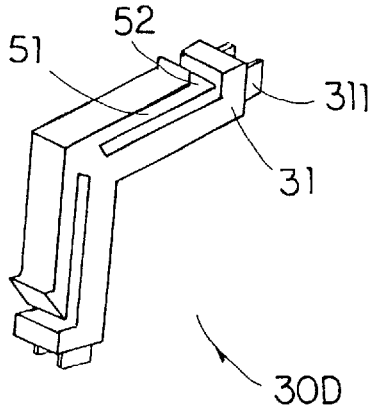

Accordingly, the connecting frame 30A, as shown in FIG. 4A, having a straight rectangular bar shaped comprises two connectors 31 in such a manner two illuminating units 10 are adapted to be parallelly connected together. FIGS. 4B to 4F illustrate the alternative modes of the connecting frame 30, wherein the connecting frames 30B, 30C have a curved and bent bar shaped respectively, as shown in FIGS. 4B to 4D, in such a manner two illuminating units 10 are connected in different arrangement with respect to the shape of the connecting frame 30.

Figure 4E:
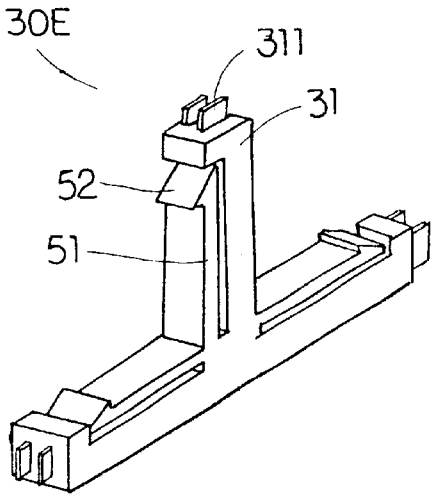
Figure 4F:
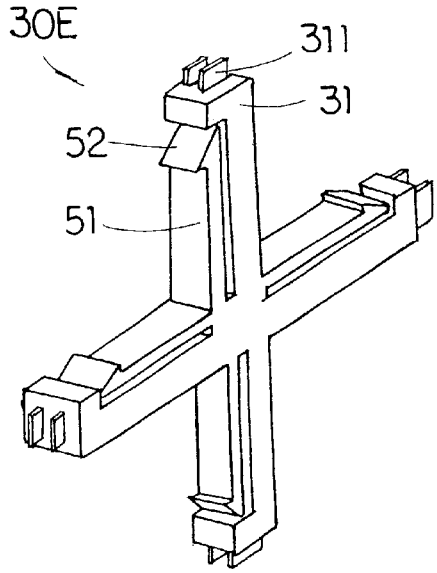
Figure 4G:
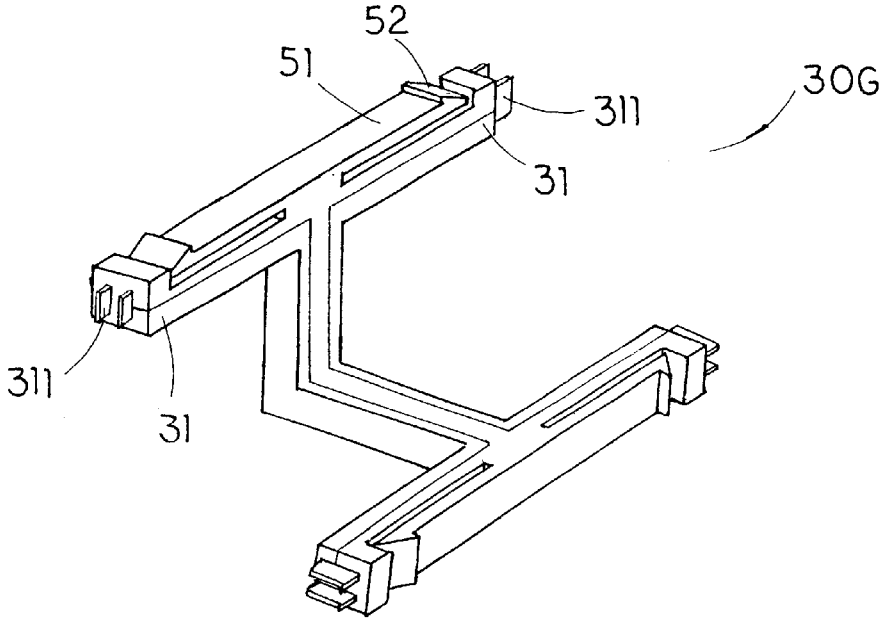

Thus, the connecting frame 30E having a "T" shaped comprises three connectors 31 extended from the ends thereof, as shown in FIG. 4E, in such a manner three illuminating units 10 are adapted to be connected together. For further modification, the connecting frame 30F having a "X" shaped, as shown in FIG. 4F, comprises four connectors 31 mounted thereon such that four illuminating units 10 can connected together at the same time. Moreover, the connecting frame 30G can have four connectors 3, which is formed by two straight rectangular bar shaped connecting frame 30A connected by a L-shaped extension, as shown in FIG. 4G.

Figure 5:
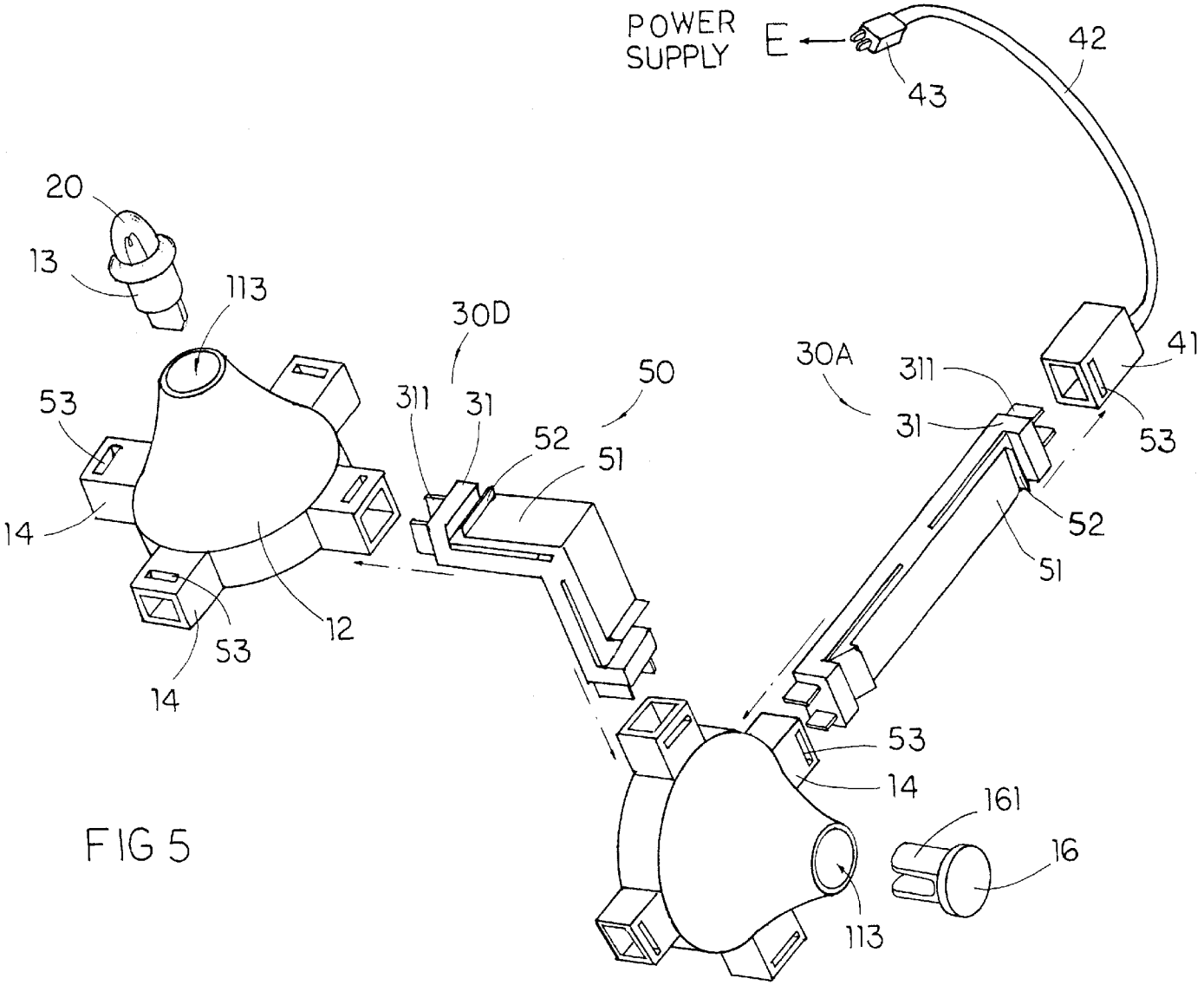
FIG. 5 is an exploded perspective view of the decorative lighting assembly according to the above preferred embodiment of the present invention.
Figure 12:
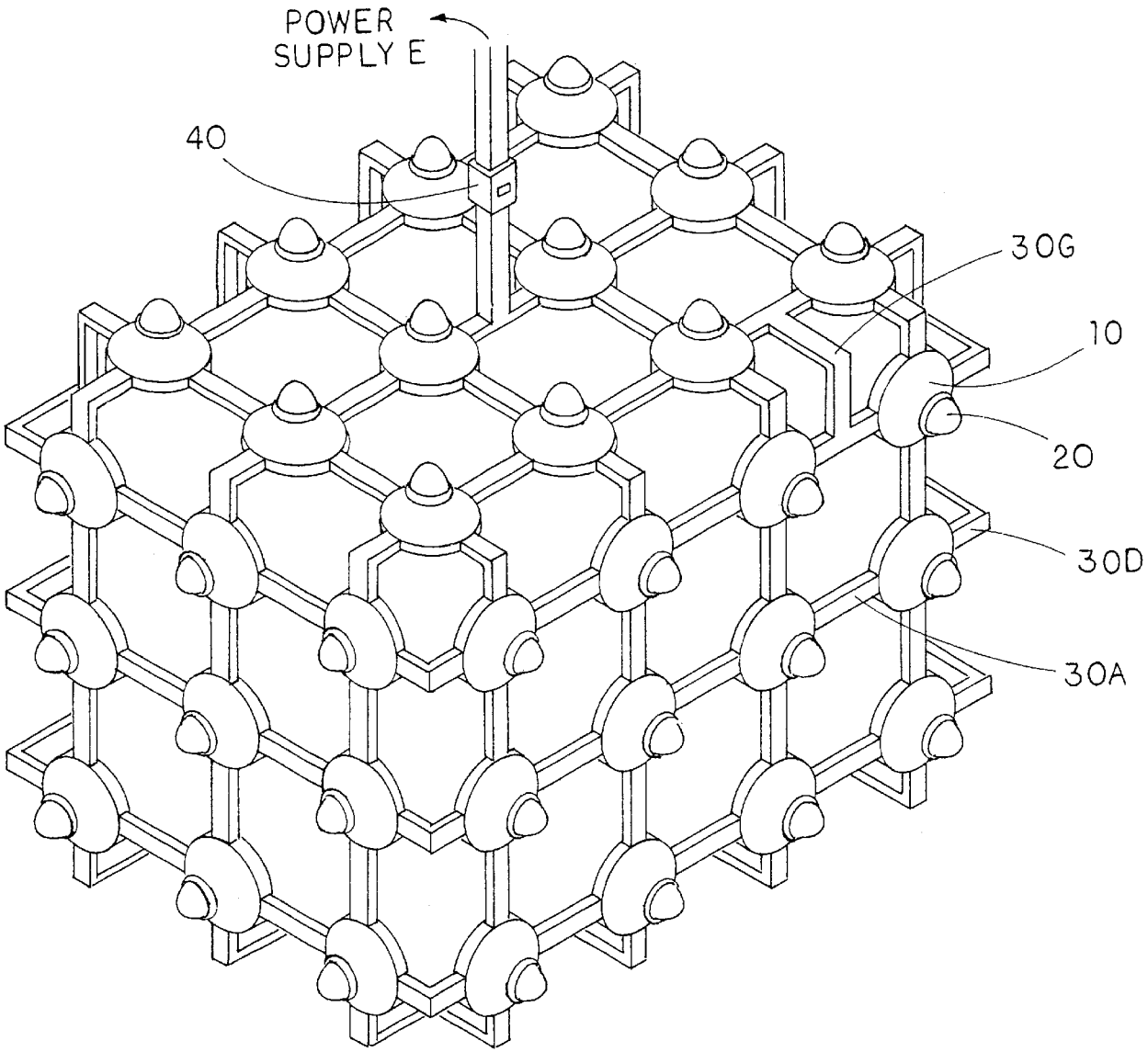
FIG. 12 is a perspective view of the decorative lighting assembly according to the above preferred embodiment of the present invention, illustrating the decorative lighting assembly being arranged in cubic shape.

Referring to FIG. 5, the illuminating units 10 are selectively arranged to form various pattern by using different shape of the supporting frame 30. In other words, by using different shapes of the connecting frame 30 for connecting with the illuminating units 10, the decorative lighting assembly 1 can form in different dimensions, especially to form a three-dimensional figure such as cube, as shown in FIG. 12.

In order to securely hold the connecting frame 30 on the illuminating unit 10, the decorative lighting assembly 1 further comprises a locking means 50 for locking up the connector 31 to the end terminal 14. The locking means 50 comprises a locking arm 51 extended toward the connector 3 1 along the connecting frame 31 wherein a locking latch 52 is integrally mounted on the locking arm 51 at its free end, as shown in FIGS. 1, 2 and 5, in flexibly movable manner. Moreover, a locker cavity 53 is perpendicularly penetrated through the guiding slot 141 in such a manner when the connecting frame 30 is inserted into the end terminal 14, the locking latch 52 is automatically engaged with the locker cavity 53 for locking up the connecting frame 30 in such a vertical movable manner. In order to unlock the locking means 50, depress the locking latch 51 in such a manner the locking latch 51 will depart from the locker cavity 53 such that the connecting frame 30 can be pull out from the end terminal 14 of the illuminating unit 10.

The power output device 40 comprises an power outlet 41 for electrically engaging with the connector 31 of the supporting frame 30, an electric cord 42 electrically connecting between the power outlet 41 and a power plug 43 for connecting to a power source such as a wall power socket.

It is worth to mention that the power source is a normal wall power socket installed at home, which provides AC current, or a battery which provides DC current. In other words, the decorative lighting assembly 1 is adapted for using AC current or DC current in such a manner the decorative lighting assembly 1 can be set up outdoors while using DC current (battery) or indoors by using AC current (power outlet) for decoration.

The illuminating units 10 are adapted to be connected as a serial connection or as a parallel connection wherein each illuminating unit 10 has a predetermined circuit diagram in such a manner each illuminating unit 10 may have different connection configuration.

Figure 6:
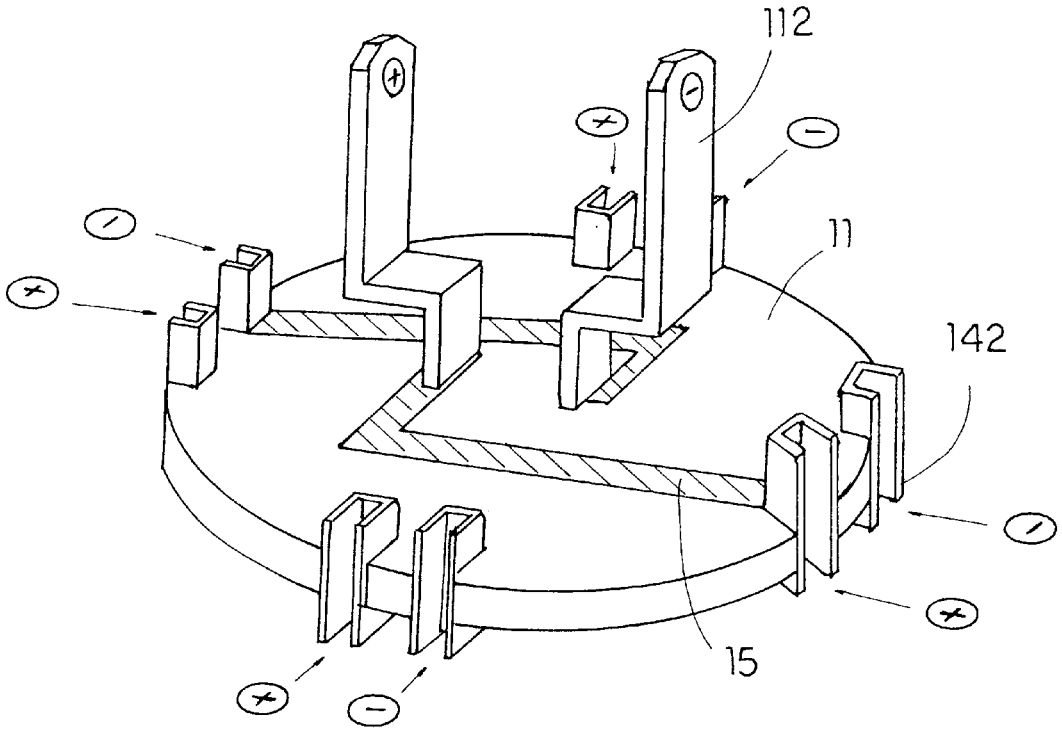
FIG. 6 is a top perspective view of the base of the decorative lighting assembly according to the above preferred embodiment of the present invention, illustrating the electric connection of the end terminals.
Figure 7:
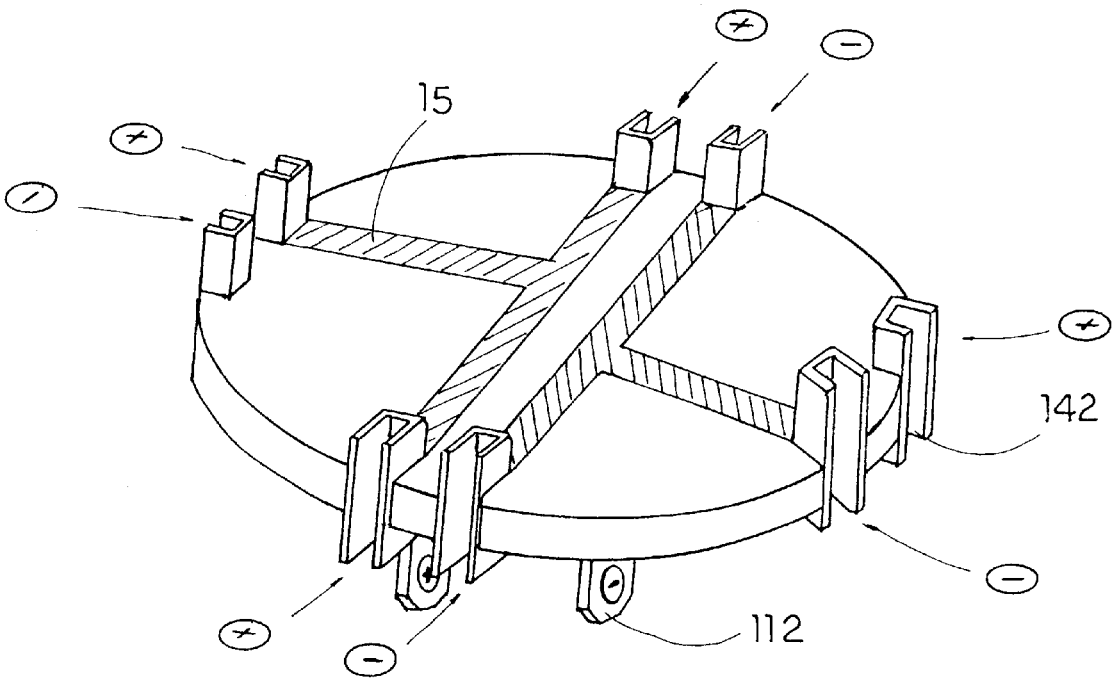
FIG. 7 is a bottom perspective view of the base of the decorative lighting assembly according to the above preferred embodiment of the present invention, illustrating the electric connection of the end terminals.
Figure 10:
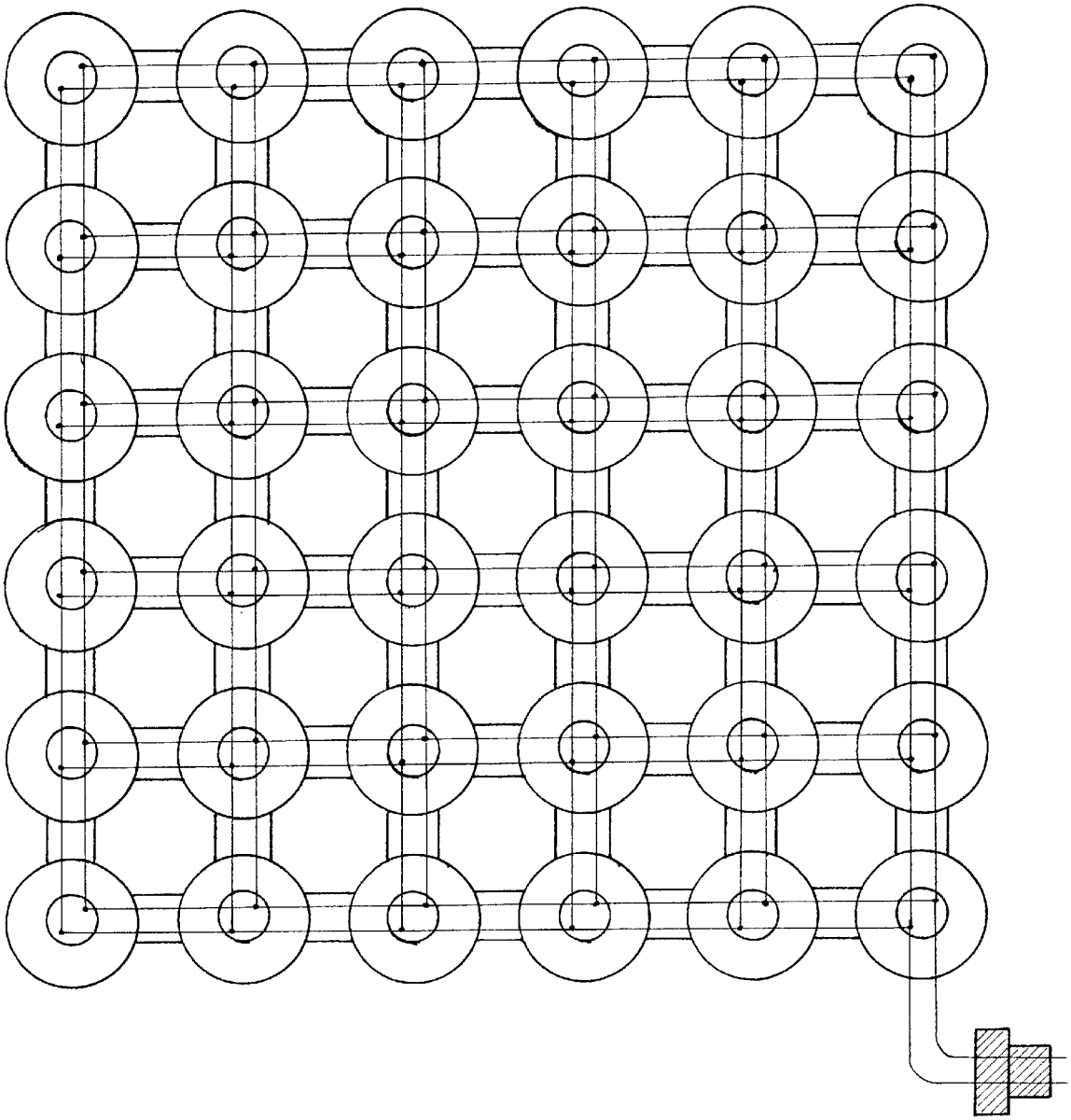
FIG. 10 illustrates a parallel electric connection of the decorative lighting assembly according to the above preferred embodiment of the present invention.

As shown in FIGS. 6 and 7, the electric configuration of the illuminating unit 10 is arranged to form a parallel connection wherein conductive elements 15 such as copper strap are provided on a top and bottom surfaces of the base 11 for electrically connecting the end terminals to the conductive arms 112. One the top surface of the base 11, a conductive element 15 is electrically extended from the charging slit 142 having a positive sign of the end terminal 14 to the conductive arm 112 having a positive sign while another conductive element 15 is electrically extended from the charging slit 142 having a negative sign of the opposed end terminal 14 to the conductive arm 112 having a negative sign. On the bottom surface of the base 11, two T-shaped conductive elements 15 each of which has three ends, wherein one of the conductive element 15 is electrically connected to three charging slit 142 each having a positive sign respectively, while another conductive element 15 is electrically connected to three charging slit 142 each having a negative sign respectively. In such arrangement, the illuminating units 10 are electrically connected as a parallel connection, as shown in FIG. 10.

Alternatively, when having a larger size of the base 11, the copper strap of the conductive element 15 may not be the best material to connect between the end terminals 14 and the conductive arms 112. So, the copper strap can be substituted by a connecting wire as the conductive element 15 in order to provide a better connection between the ends terminals 14 and the conductive arms 112, as shown in FIG. 8F.

Figure 9:
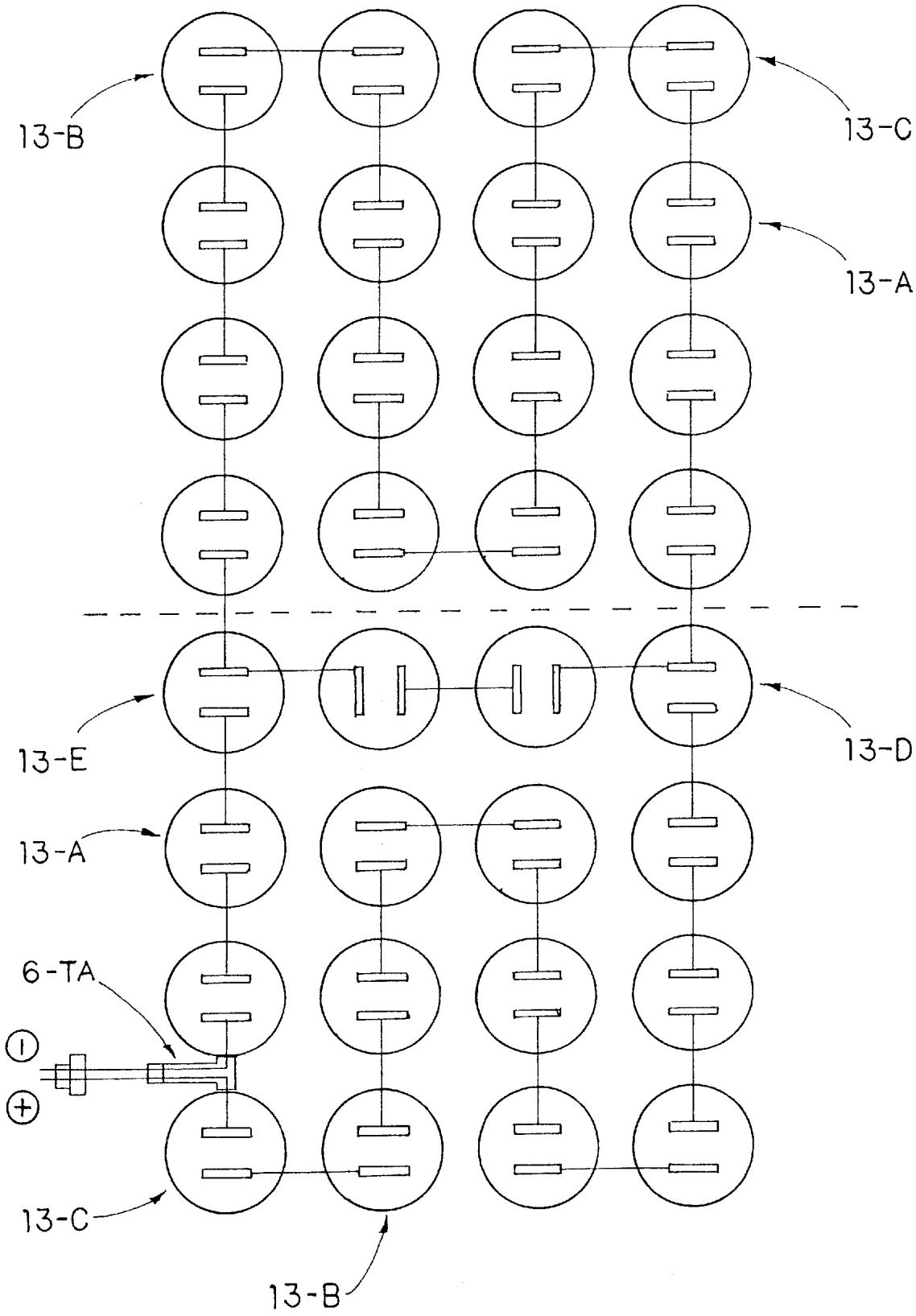
FIG. 9 illustrates a serial electric connection of the decorative lighting assembly according to the above preferred embodiment of the present invention.
Figure 11:
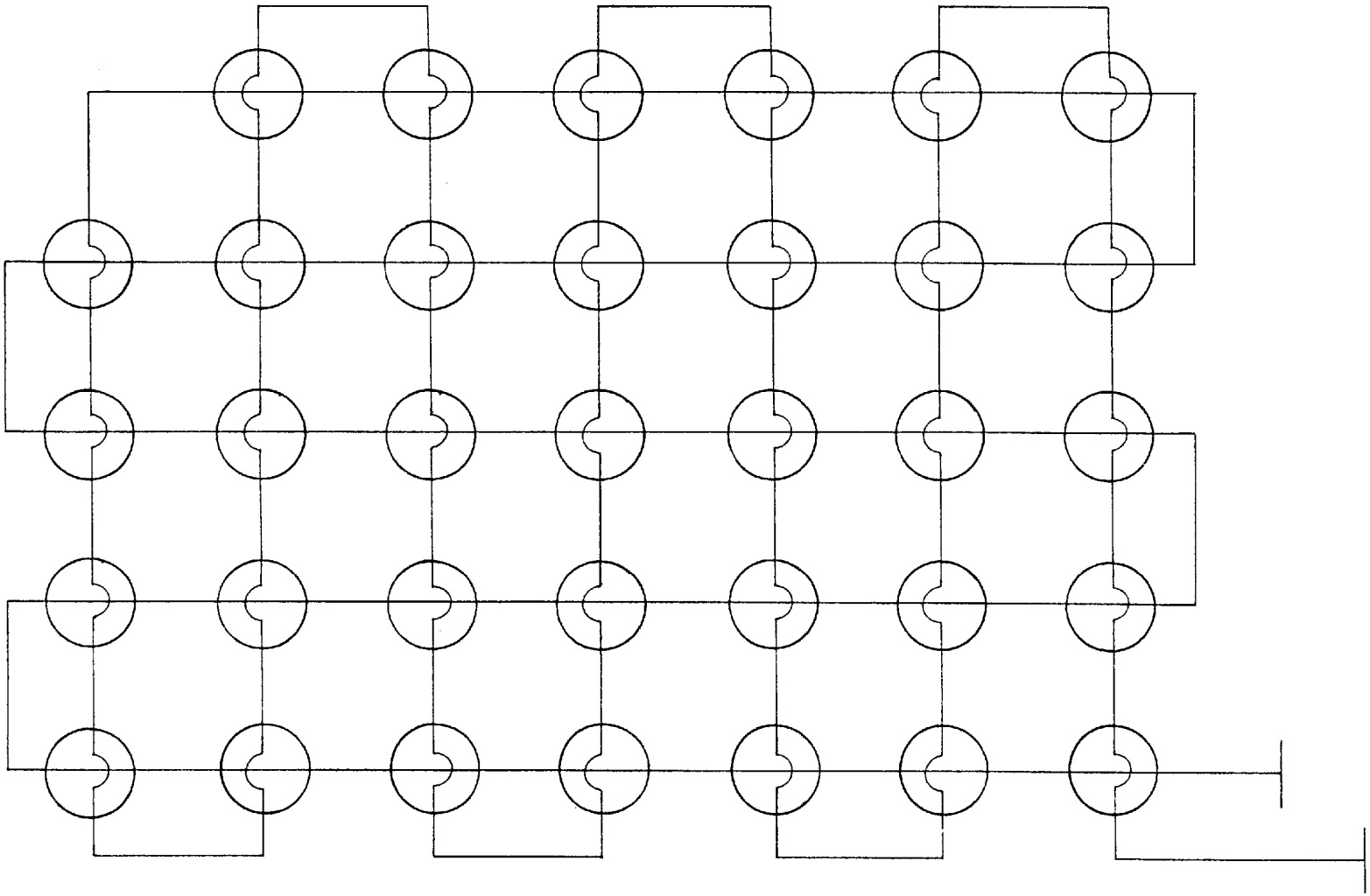
FIG. 11 is a circuit diagram of the decorative lighting assembly as a serial connection according to the above preferred embodiment of the present invention.

As shown in FIGS. 9 and 11, the illuminating units 10 are configured as a serial connection wherein each of illuminating units 10 has different connection path in such a manner each illuminating unit 10 can be selectively arranged to form different formation according to the connection path.

Figure 8A:
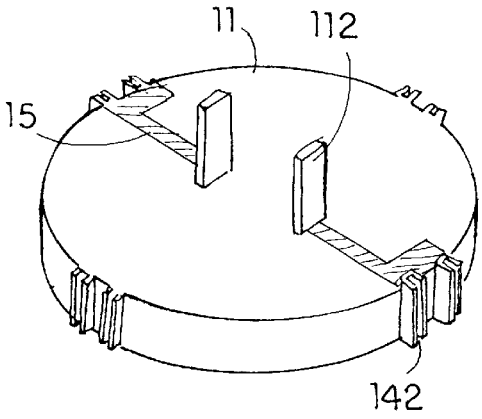
FIGS. 8A to 8F illustrate an alternative mode of the electric connection of the end terminals of the base of the decorative lighting assembly according to the above preferred embodiment of the present invention.
Figure 8B:
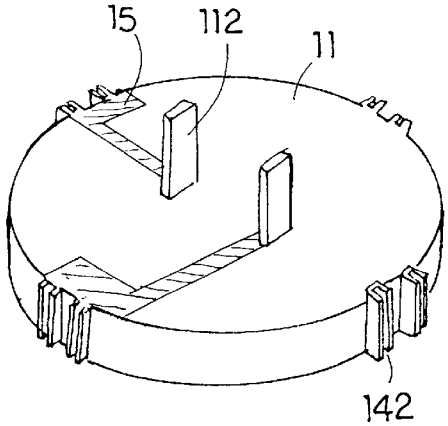
Figure 8C:
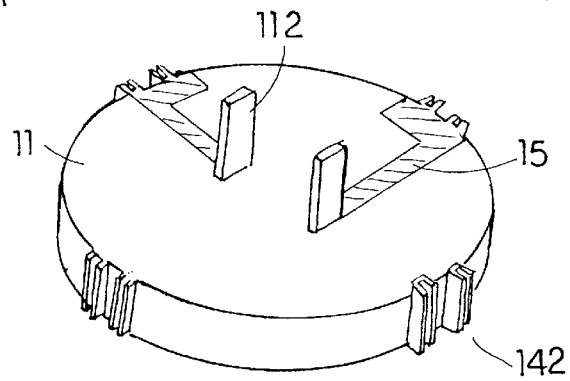
Figure 8E:
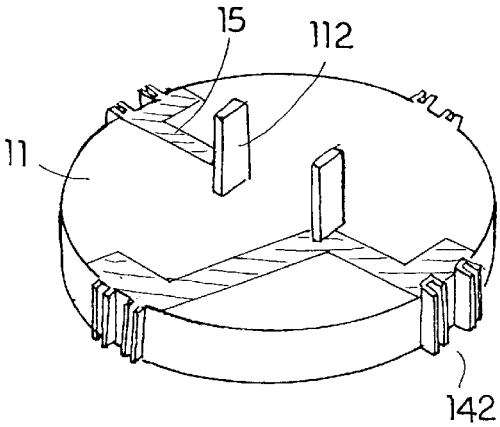
Figure 8D:
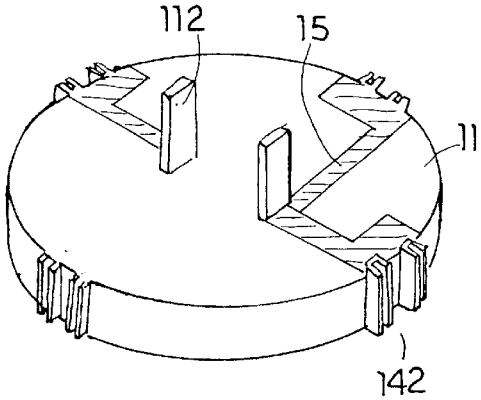
Figure 8F:
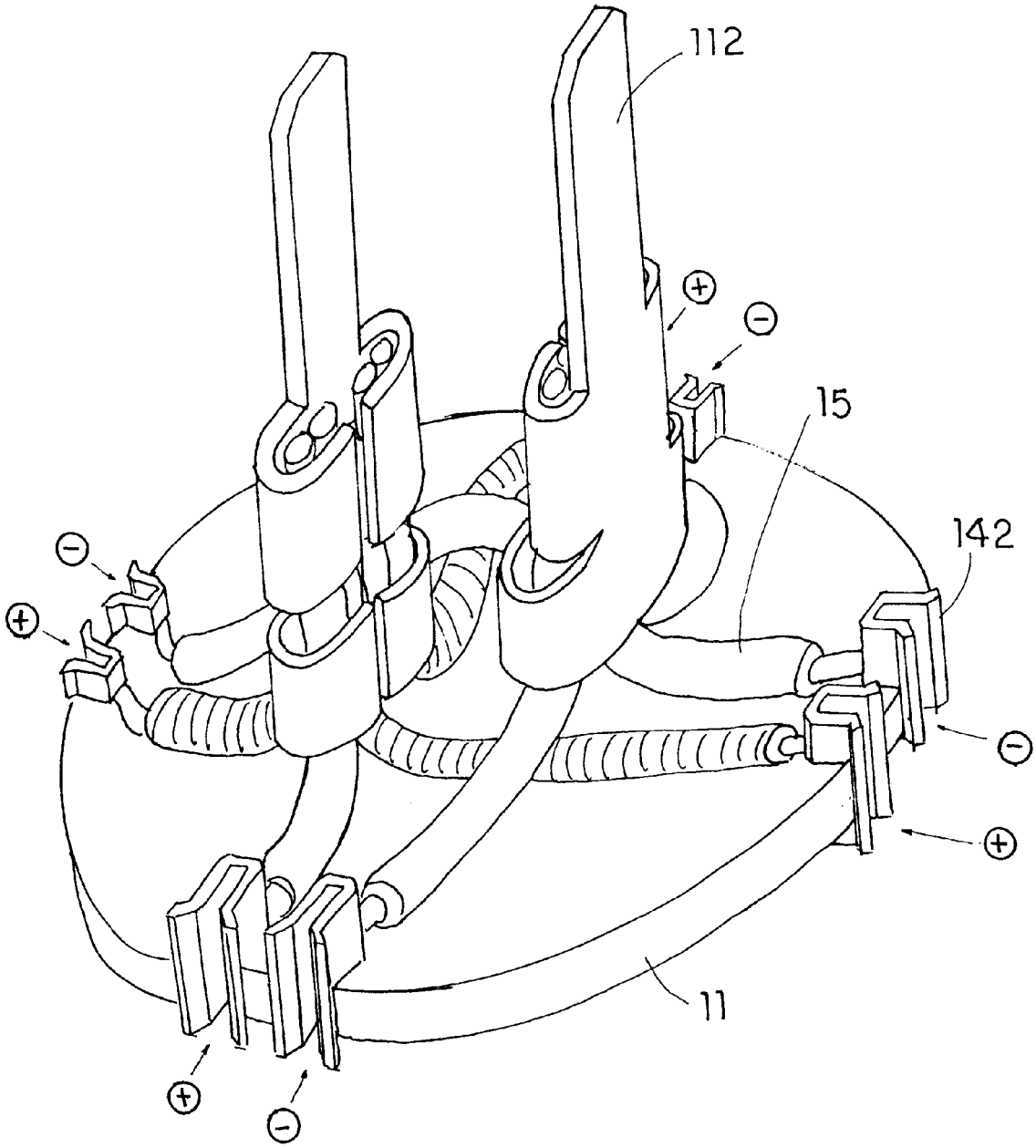

FIG. 8A illustrates the opposed end terminals 14 are electrically connected as a serial connection. FIGS. 8B and 8C illustrate two neighboring end terminals 14 are electrically connected as a serial connection wherein the end terminals 142 are electrically connected to the right and left neighboring end terminals 14 respectively. FIGS. 8D and 8E illustrate three end terminals 14 are electrically connected as a serial connection wherein the end terminals 14 are respectively connected between the opposed end terminal 14 and the right end terminal 14 and between the opposed end terminal 14 and the left terminal 14. Thus, as shown in FIG. 8F, the illuminating unit 10 has four end terminals 14 which are adapted to electrically and selectively connect each other, so as to connect four connecting frames 30 at the same time.

However, the disadvantage of the serial connection of the illuminating units 10 is that when one of the illuminating units 10 is not in used, the rest of the illuminating units 10 will not be functioned as well. So, when the illuminating units 10 are selectively connected together in such a manner the lightened illuminators 20 are arranged to form a designated pattern. So, some of the illuminators 20 may be intentionally switched off, however, the circuit of the illuminating units 10 will be disconnected. In order to maintain a closed circuit of the illuminating units 10, the decorative lighting assembly 1 further comprises a circuit connector 16 having a pair of connecting legs 161 downwardly extended therefrom wherein the circuit connector 16 is adapted to electrically connect between the two conductive arms 112 of the base 11, as shown in FIG. 5. Simply remove the unused illuminator 20 of the illuminating unit 10, and plug the circuit connector 16 into the holder chamber 113, the two conductive arms 112 will be electrically connected together, so as to provide a closed circuit of the illuminating units 10.

Figure 13:
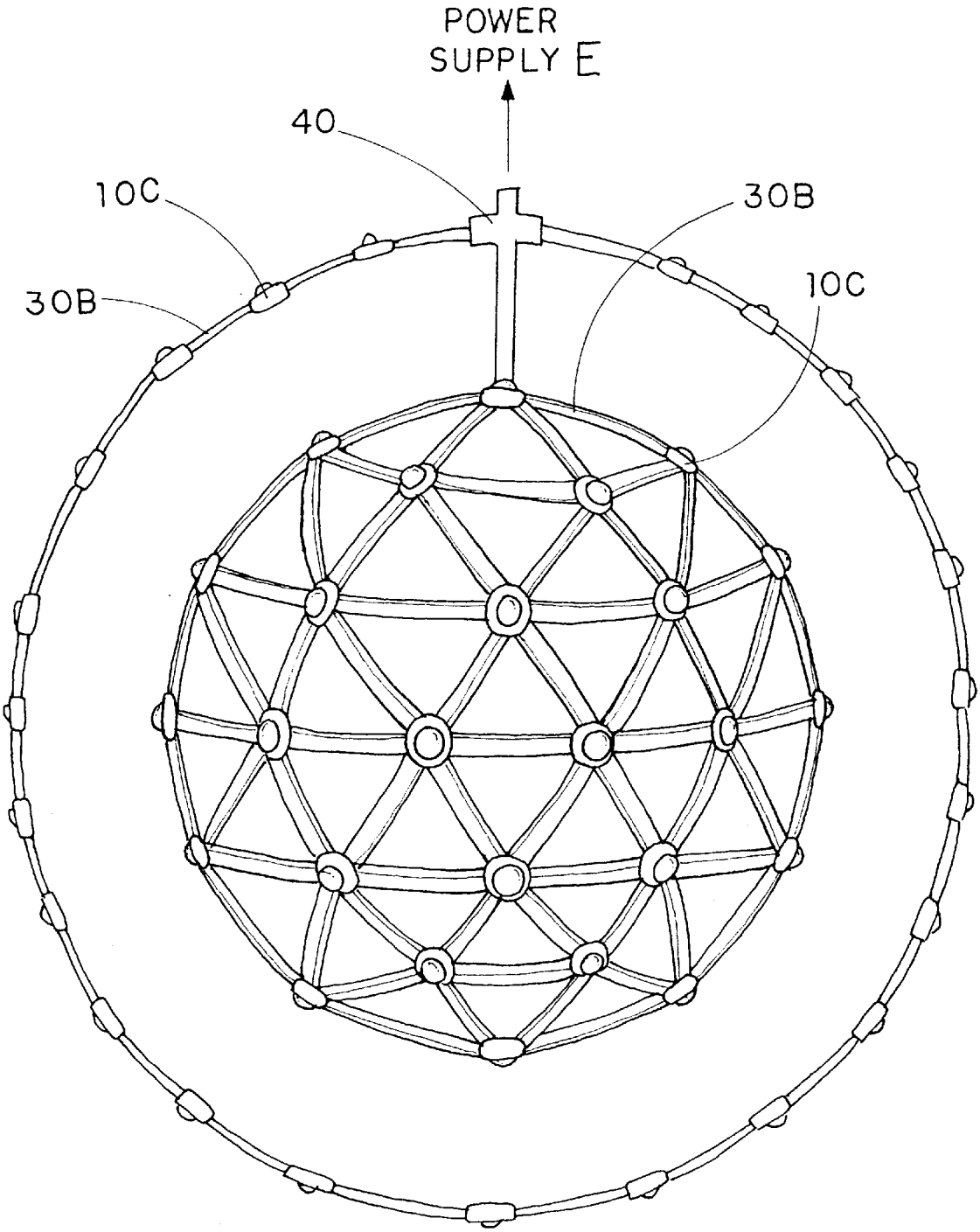
FIG. 13 is a perspective view of the decorative lighting assembly according to the above preferred embodiment of the present invention, illustrating the decorative lighting assembly being arranged in spherical shape.

As it is mentioned above, by using different shapes of the supporting frame 30, the illuminating units 10 are adapted to form a 2D or 3D structure. In 3D application, the illuminating units 10 each having four end terminals 14 are adapted for electrically connecting together in order to form a cubic shape, as shown in FIG. 12. For further complex application, the illuminating units 10 each having six end terminals 14 can be arranged to form a smaller sphere inside a bigger sphere, as shown in FIG. 13.

Figure 14:
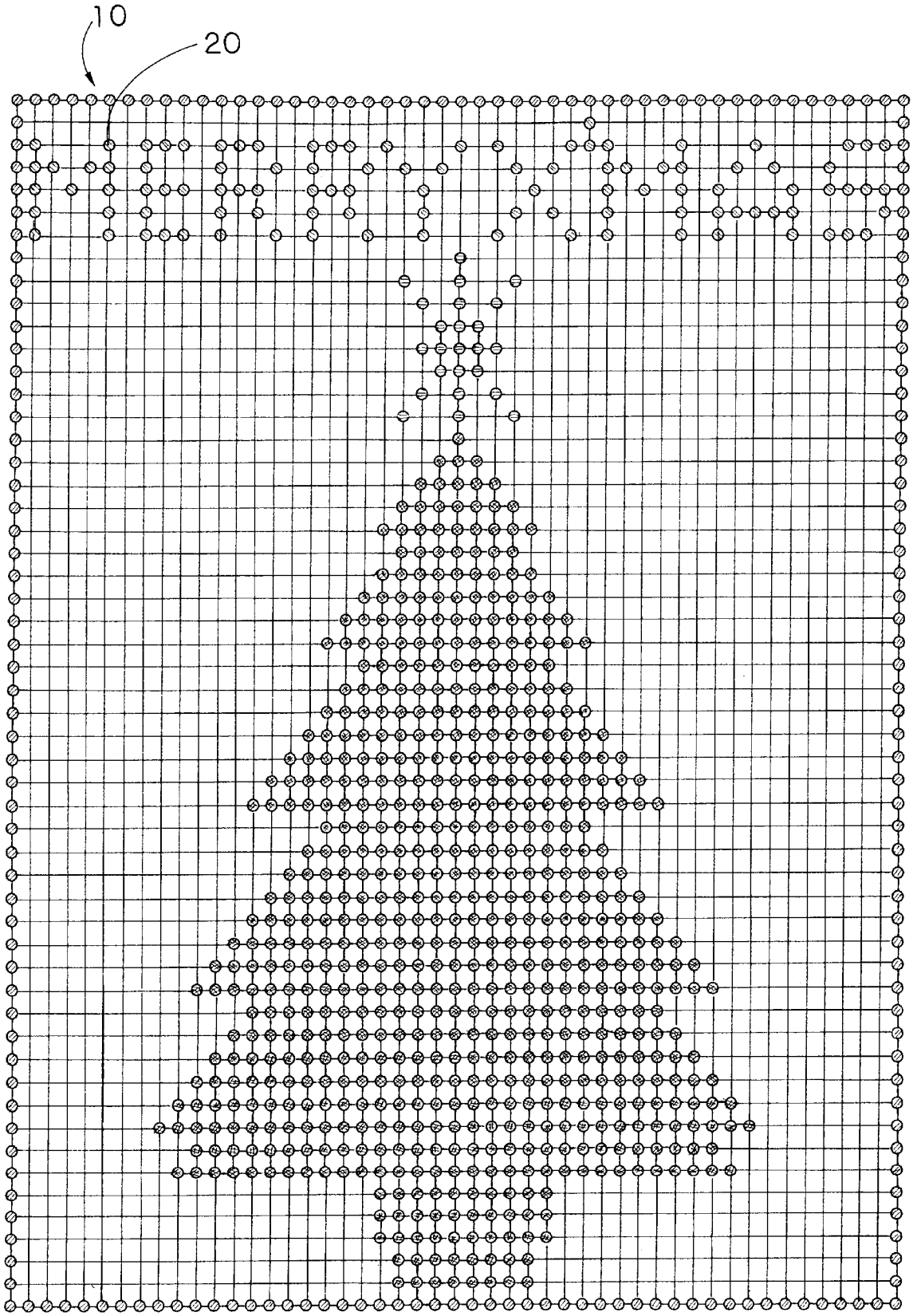
FIG. 14 is a perspective view of the decorative lighting assembly according to the above preferred embodiment of the present invention, illustrating the decorative lighting assembly being arranged to form a character.

For 2D application, the illuminating units 10 are lined-up together wherein the illuminators 20 are selectively arranged to have different colors, so as to form a character such as an alphabet or number, or a figure, as shown in FIG. 14.

What is claimed is:

1. A decorative lighting assembly, comprising:

a plurality of illuminating units each comprising a base having at least two end terminals provided on said base, a pair of conductive arms upwardly extended from said base wherein said end terminals are selectively and electrically connected to said conductive arms respectively, a casing sealedly mounted on said base, and an illuminator detachably mounted on said casing and electrically connected with said conductive arms, a plurality of connecting frames each comprising at least two connectors at ends thereof respectively for connecting with said end terminals of said illuminating units, so as to electrically connect at least two said illuminating units together in such a manner that said illuminating units are selectively aligned to form a dimensional arrangement, and a power output device electrically connected said illuminating units with a power source.

2. A decorative lighting assembly, as recited in claim 1, wherein a pair of charging slits has a positive and a negative sign parallelly mounted on each said end terminal at an inner end thereof for electrically engaging with a pair of charging heads corresponding mounted on said connector of said connecting frame.

3. A decorative lighting assembly, as recited in claim 1, wherein a plurality of conductive elements are respectively provided on a top and a bottom surface of said base for selectively and electrically connecting said end terminals with said conductive arms.

4. A decorative lighting assembly, as recited in claim 2, wherein a plurality of conductive elements are respectively provided on a top and a bottom surface of said base for selectively and electrically connecting said charging slit of said end terminals with said conductive arms, so as to arrange said illuminating units as a serial electrical connection.

5. A decorative lighting assembly, as recited in claim 2, wherein a plurality of conductive elements are respectively provided on a top and a bottom surface of said base for selectively and electrically connecting said charging slit of said end terminals with said conductive arms, so as to arrange said illuminating units as a parallel electrical connection.

6. A decorative lighting assembly, as recited in claim 1, further comprising a locking means for locking up said connector to said end terminal wherein said locking means comprising a locking arm extended toward said connector along said connecting frame, a locking latch integrally mounted on said locking arm at a free end thereof in flexibly movable manner, and a locker cavity provided on said end terminal in such a manner that when said connecting frame is fittingly connected with said end terminal, said locking latch is automatically engaged with said locker cavity for locking up said connecting frame in a slidably movable manner.

7. A decorative lighting assembly, as recited in claim 4, further comprising a locking means for locking up said connector to said end terminal wherein said locking means comprising a locking arm extended toward said connector along said connecting frame, a locking latch integrally mounted on said locking arm at a free end thereof in flexibly movable manner, and a locker cavity provided on said end terminal in such a manner that when said connecting frame is fittingly connected with said end terminal, said locking latch is automatically engaged with said locker cavity for locking up said connecting frame in a slidably movable manner.

8. A decorative lighting assembly, as recited in claim 5, further comprising a locking means for locking up said connector to said end terminal wherein said locking means comprising a locking arm extended toward said connector along said connecting frame, a locking latch integrally mounted on said locking arm at a free end thereof in flexibly movable manner, and a locker cavity provided on said end terminal in such a manner that when said connecting frame is fittingly connected with said end terminal, said locking latch is automatically engaged with said locker cavity for locking up said connecting frame in a slidably movable manner.

9. A decorative lighting assembly, as recited in claim 4, wherein each said illuminating unit further comprises a holder for securely holding said illuminator on said casing, wherein a pair of charging legs of said illuminator are penetrated through a bottom portion of said holder and are respectively bent at two opposing sides of said bottom portion of said holder in such a manner that said holder is securely mounted on said casing in such a waterproof manner and said charging legs are electrically connected with said conductive arms of said base.

10. A decorative lighting assembly, as recited in claim 5, wherein each said illuminating unit further comprises a holder for securely holding said illuminator on said casing, wherein a pair of charging legs of said illuminator are penetrated through a bottom portion of said holder and are respectively bent at two opposing sides of said bottom portion of said holder in such a manner that said holder is securely mounted on said casing in such a waterproof manner and said charging legs are electrically connected with said conductive arms of said base.

11. A decorative lighting assembly, as recited in claim 7, wherein each said illuminating unit further comprises a holder for securely holding said illuminator on said casing, wherein a pair of charging legs of said illuminator are penetrated through a bottom portion of said holder and are respectively bent at two opposing sides of said bottom portion of said holder in such a manner that said holder is securely mounted on said casing in such a waterproof manner and said charging legs are electrically connected with said conductive arms of said base.

12. A decorative lighting assembly, as recited in claim 8, wherein each said illuminating unit further comprises a holder for securely holding said illuminator on said casing, wherein a pair of charging legs of said illuminator are penetrated through a bottom portion of said holder and are respectively bent at two opposing sides of said bottom portion of said holder in such a manner that said holder is securely mounted on said casing in such a waterproof manner and said charging legs arc electrically connected with said conductive arms of said base.

13. A decorative lighting assembly, as recited in claim 9, wherein each said illuminating unit further comprises a circuit connector having a pair of connecting legs downwardly extended therefrom wherein said circuit connector is adapted to electrically connect between said two conductive arms of said base when said illuminator is removed, so as to maintain a closed circuit of said decorative lighting assembly.

14. A decorative lighting assembly, as recited in claim 10, wherein each said illuminating unit further comprises a circuit connector having a pair of connecting legs downwardly extended therefrom wherein said circuit connector is adapted to electrically connect between said two conductive arms of said base when said illuminator is removed, so as to maintain a closed circuit of said decorative lighting assembly.

15. A decorative lighting assembly, as recited in claim 11, wherein each said illuminating unit further comprises a circuit connector having a pair of connecting legs downwardly extended therefrom wherein said circuit connector is adapted to electrically connect between said two conductive arms of said base when said illuminator is removed, so as to maintain a closed circuit of said decorative lighting assembly.

16. A decorative lighting assembly, as recited in claim 12, wherein each said illuminating unit further comprises a circuit connector having a pair of connecting legs downwardly extended therefrom wherein said circuit connector is adapted to electrically connect between said two conductive arms of said base when said illuminator is removed, so as to maintain a closed circuit of said decorative lighting assembly.

17. A decorative lighting assembly, as recited in claim 7, wherein said illuminator is a LED.

18. A decorative lighting assembly, as recited in claim 8, wherein said illuminator is a LED.

19. A decorative lighting assembly, as recited in claim 11, wherein said illuminator is a LED.

20. A decorative lighting assembly, as recited in claim 12, wherein said illuminator is a LED.

* * * * *